United States Patent [19]

Nauta

[11] 3,986,705

[45] Oct. 19, 1976

[54] METHOD AND DEVICE FOR CONTINUOUSLY MIXING AND/OR GRANULATING SUBSTANCES

[75] Inventor: Constant Johan Nauta, Overveen, Netherlands

[73] Assignee: Nautamix Patent A.G., Zug, Switzerland

[22] Filed: Oct. 29, 1974

[21] Appl. No.: 518,744

[30] Foreign Application Priority Data

Oct. 30, 1973 Netherlands ..... 7314908

[52] U.S. Cl. ..... 259/8

[51] Int. Cl.[2] ..... B01F 7/20; B01F 15/02

[58] Field of Search ..... 259/8, 111, 99, 102, 259/147, 5, 6, 7, 22, 23, 24, 41, 42, 43, 44

[56] References Cited

UNITED STATES PATENTS

| | | | |
|---|---|---|---|
| 1,097,084 | 5/1914 | Eichelberger | 259/147 |
| 2,556,486 | 6/1951 | Smith | 259/102 |
| 3,502,305 | 3/1970 | Grün | 259/8 |
| 3,854,702 | 12/1974 | Papenmeier | 259/8 |

*Primary Examiner*—Peter Feldman
*Assistant Examiner*—Donald B. Massenberg
*Attorney, Agent, or Firm*—Wilkinson, Mawhinney & Theibault

[57] ABSTRACT

A method and a device for performing said method for mixing and/or granulating pulverulent- or granular substances and at least one liquid in a continuous process, while the material is moved in a vessel from top to bottom and at least at one location of the vessel is eddied reducing at the same time the density of the mass of substance at the related location.

2 Claims, 4 Drawing Figures

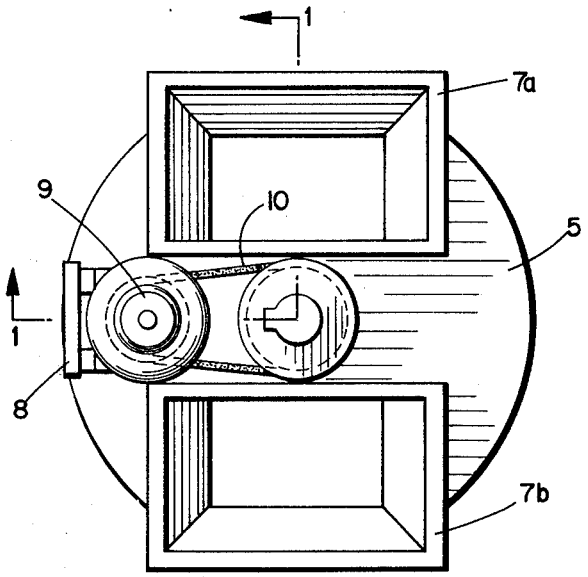
FIG. 2
FIG. 1
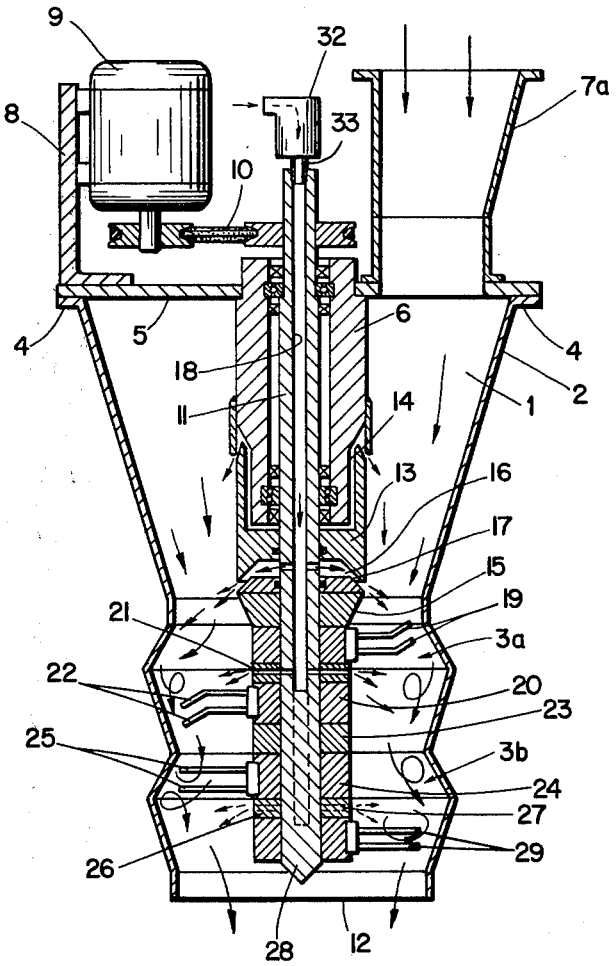

METHOD AND DEVICE FOR CONTINUOUSLY MIXING AND/OR GRANULATING SUBSTANCES

BACKGROUND OF THE INVENTION

My invention relates to a method for mixing and/or granulating pulverulent- or granular substances and at least one liquid in a continuous process, while the material in a vessel is moved from top to bottom and at least at one location of the vessel is eddied.

SUMMARY OF THE INVENTION

My invention aims to provide an improved method and a device for performing said improved method. Concerning the method according to the invention the eddy is generated reducing at the same time the density at the related location. This method results in a very homogenous mixing of the pulverulent or granular substances together with one or more liquids, if any, resulting eventually in an excellent granulation, whereby fine powder particles are formed into larger grains and are kept together by means of a binding agent which normally is supplied during the process.

The device for performing the method according to my invention consists of a vessel in which means are arranged for eddying at one or more locations a material moving in the vessel from top to bottom and is characterized in that the vessel has at least one vortex space for eddying the material, the cross section of said vortex space varying in respect of the cross section of the entrance to the vortex space. Preferably the cross section of the vortex space at first increases and thereafter decreases. When the device comprises a plurality of vortex spaces one situated under the other then according to the invention for each vortex space the cross section of the outlet practically can be equal to the cross section of the inlet.

In special cases when a column of vortex spaces are situated one under the other the cross section of each vortex space can be constant for the entire height. However, it is possible also that each vortex space at first increases for a part of the height of the space thereafter remaining constant.

The device is provided with a spindle disposed in the central axis of symmetry of the vessel and rotatably supported therein and according to the invention at the location of each vortex space the spindle is provided with at least one set of striking elements for eddying the material. The striking elements can be supported in the spindle suchlike that they are rotatable about their own axis and, if desired, are groupwise situated at the same level and distributed about the circumference of the spindle.

It is also possible according to the invention to provide at the location of each vortex space one or more connections in the wall of the vessel for blowing a gas, e.g. air, into the vortex space, while preferably said connections are distributed about the circumference of the wall of the vessel. According to my invention at least one axially extending channel is provided in the lower end of the spindle each channel debouching into a discharge device mounted on the spindle so that a liquid material supplied through said channel is introduced in one or more vortex spaces under pressure into the substance mass to be treated.

SURVEY OF THE DRAWINGS

FIG. 1 is an axial section through the device, the part of vessel situated above the upper closure of the vessel represented according to the line I—I in FIG. 2.

FIG. 2 is a plan view of the device;

DESCRIPTION OF PREFERRED EMBODIMENTS

Figure 3:
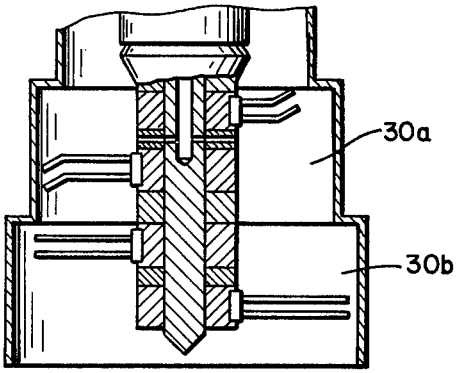
FIGS. 3 and 4 are respectively axial sections through modified embodiments of the lower part of the device.

The device consists of a vessel 1 the circumferential wall 2 of which is shaped at its lower end so that two vortex spaces 3*a* and 3*b* are formed in the vessel 1. Obviously the number of two is not imperative whereas the cross section of the vessel 1 above the vortex space may be conically widening but also be cylindrical. At its upper end the wall 2 of the vessel is provided with a flange 4 on which is secured a closing plate 5. In the central part of the closing plate 5 is secured the upper end of a sleeve 6 which extends downwardly according to the vertical axis of symmetry of the vessel 1. Furthermore two inlet funnels 7*a* and 7*b*, corresponding with inlet openings are symmetrically arranged one opposite the other on either side of the upper end of the sleeve 6 (see FIG. 2). On an upright 8 is arranged between the inlet funnels 7*a* and 7*b* an electric motor 9 which is secured to the closing plate 5 and via a transmission 10 can rotate a spindle 11. The spindle 11 its upper end protruding from the sleeve 6 is rotatably and dustproof supported in the sleeve 6 and extends in the vertical axis of symmetry to the vicinity of the lower outlet 12 of the vessel 1. The lower part of the sleeve 6 having a cross section smaller than the rest is inserted into a cavity of a holder 13 fixedly secured to the spindle 11. A cylindrical slit 14 is provided between the holder 13 and the sleeve 6.

A holder 15 secured to the spindle 11 is arranged under the holder 13 so that between the holders 13 and 15 is provided an open space 16 which via a slit 17 debouches into the vessel 1. The space 16 communicates via bores in the wall of the spindle 11 with a channel 18 arranged centrically in longitudinal direction in said spindle 11. On the lower part of the holder 15 is mounted a set of stirring elements two of which denoted by 19 visible in FIG. 1. This set of stirring elements is situated in the vortex space 3*a* of the vessel 1. A holder 20 is fixedly secured to the spindle 11 under the holder 15 a slit-spaced room 21 provided between the holders 15 and 20 said room 21 debouching at its outside into the vessel 1 communicating at its inside with the channel 18 in the spindle 11. On the holder 20 is likewise mounted a set of stirring elements two of which denoted by 22 visible in FIG. 1. Said stirring elements 22 are also situated in the vortex space 3*a*. A spacer 23 fixedly secured to the spindle 11 separates the holder 20 from a holder 24 likewise fixedly secured to the spindle 11 said holder 24 carrying a set of stirring elements situated in the vortex space 3*b*, two of said elements denoted by 25 visible in FIG. 1. A spacer 26 is fixedly secured to the spindle 11, said spacer 26 eventually provided with channels 27 debouching at their outside into the vessel 1 and at the inside communicating with the channel 18, which in said case extends to the vicinity of the closed end 28 of the spindle 11. A set of stirring elements, two of which are denoted by 29 in FIG. 1, is fixedly secured to the spindle 11. These elements 29 are situated in the vortex space 3*b*.

Figure 4:
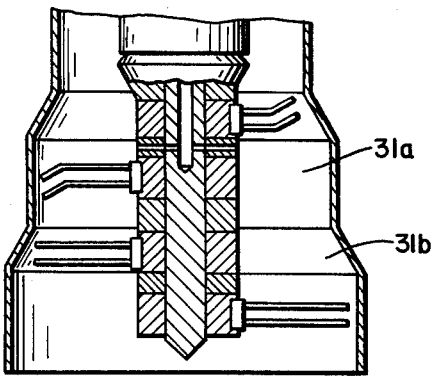

The vortex spaces in the vessel 1 also may be shaped otherwise, whereas the cross section of each vortex space 30*a* and 30*b* respectively can be indentical over its entire height (see FIG. 3), or the cross section of each vortex space 31*a* and 31*b* respectively increasing over a part of its height thereafter remaining identical (see FIG. 4).

An inlet head 32 for the liquid is arranged upon the upper end of the spindle 11, the spindle arranged rotatably about the spout 33 of said inlet head 32.

The effect is as follows. Via the inlet funnels 7*a* and 7*b* a pulverulent or granular substance is introduced uniformly into the vessel 1. The mass of substance falls evenly distributed about the sleeve 6 and the holder 13 and in the vicinity of the vortex space 3*a* (see FIG. 1) is mixed together with a liquid which is supplied via the inlet head and the channel 18 provided in the rotating spindle 11 and finely divided introduced into the mass of substance. Immediately thereafter the mass of substance passes the entry of the vortex space 3*a* in which the density of the mass of substance is reduced, while simultaneously the mass of substance is vigorously eddied by the stirring elements 19 rotating with the spindle 11 about the central axis of the vessel. Via the channels 21 the liquid supplied via the channel 18, again is finely divided introduced into the mass of substance, whereafter said mass of substance becoming slightly denser. After passig the entrance to the vortex space 3*b* the density of the mass of substance again is reduced and the stirring elements 25 eddy the mass of substance once more. In particular cases this process can be repeated by means of injection channels 27 and the stirring elements 29 before the treated mass of substance leaves the vessel continuously via the outlet 12.

Within the scope of the invention it is possible to realize various constructive details otherwise. This applies particularly to the shape of the stirring elements and the way in which said elements are arranged on their relative holders. Furthermore it is possible to provide more channels in longitudinal direction in the spindle so that different liquids can be supplied, each channel communicating with the mouths of particular members arranged on the spindle for introducing said liquids finely divided into the mass of substance.

What I claim is:

1. The method for mixing and/or granulating pulverent or granular substances and at least one liquid in a continuous process while the material in a vessel is moved from top to bottom, subjecting the mixture to an initial increase in density followed by a decrease in mixture density along the axis of the vessel from top towards its bottom, generating a vortex in the area of decrease in mixture density with stirring elements and at least part of the liquid is added in a rotary action in the area of decrease of density immediately following stirring of the mixture.

2. The method of claim 1 wherein the mixture is subjected to a plurality of areas of decrease in mixture density along the axis of the vessel promoted by gravity assist.

* * * * *